United States Patent [19]

Boucher

[11] Patent Number: 4,889,306

[45] Date of Patent: Dec. 26, 1989

[54] SCUBA TANK MOUNTING BRACKET

[76] Inventor: Robert C. Boucher, 26 Allan Dr., Vernon, Conn. 06066

[21] Appl. No.: 247,036

[22] Filed: Sep. 20, 1988

[51] Int. Cl.[4] ..... B63C 11/52

[52] U.S. Cl. ..... 248/313; 114/315; 405/187

[58] Field of Search ..... 248/534, 535, 539, 540, 248/541, 65, 68.1, 74.1, 74.3, 231, 309.1, 311.2, 313; 114/315; 440/6; 24/288; 405/186, 187

[56] References Cited

U.S. PATENT DOCUMENTS

| | | | |
|---|---|---|---|
| 1,540,758 | 6/1925 | Burke | 248/313 |
| 1,547,014 | 7/1925 | Bantel | 248/313 |
| 2,615,238 | 10/1952 | Highwood | 248/311.2 |
| 2,837,217 | 6/1958 | Norris | 248/311.2 |
| 2,968,159 | 1/1961 | Edmund | 405/186 |
| 3,065,888 | 11/1962 | Lande | 405/186 |
| 3,670,509 | 6/1972 | Walters | 114/315 |
| 3,791,403 | 2/1974 | Folkerth | 248/313 |
| 3,842,611 | 10/1974 | Anderson | 114/315 |
| 4,640,215 | 2/1987 | Purifoy | 114/315 |
| 4,773,348 | 9/1988 | Rowley | 248/311.2 |

FOREIGN PATENT DOCUMENTS

| | | | |
|---|---|---|---|
| 40962 | 12/1971 | Japan | 248/68.1 |

*Primary Examiner*—Ramon O. Ramirez
*Assistant Examiner*—Robert A. Olson
*Attorney, Agent, or Firm*—Fishman, Dionne & Cantor

[57] ABSTRACT

A SCUBA tank mounting adapter, for mounting two SCUBA tanks to a single tank SCUBA backpack is presented. The adapter has two tank acceptors, a mounting bracket and straps to hold tanks in place. The tank acceptors are attached to the mounting bracket and the straps surround the acceptors. In accordance with this invention, the tanks can be of different sizes and diameters and still fit onto the same adapter.

5 Claims, 2 Drawing Sheets

SCUBA TANK MOUNTING BRACKET

BACKGROUND OF THE INVENTION

The present invention relates to brackets for mounting SCUBA tanks onto standard SCUBA backpacks. More particularly, the present invention relates to a bracket for mounting two SCUBA tanks of any size onto a single tank SCUBA backpack.

Backpacks for SCUBA divers hold either one tank or two tanks. The most common backpack is the single tank backpack. This type is less expensive than a dual tank backpack, and a single tank meets the needs of most divers.

A two tank backpack is necessary for deep or prolonged dives, where the diver will exceed the time alotted for a single tank. If the owner of a single tank backpack wants to go on a prolonged dive, he will either have to rent a dual tank backpack, or use an adapter for mounting another tank to his backpack. Unfortunately, presently available adapters for modifying single tank backpacks to hold dual tanks are unsafe, inconvenient and time consuming.

Compressed air tanks suitable for SCUBA diving have many different sizes and diameters. To adapt a single tank backpack to a dual tank backpack currently requires two tanks of equal size and shape. However, because many divers will own just a single tank, if they go on a prolonged dive they will need two tanks. Since it is difficult for the diver to find another tank of equal size to his own, the diver is often required to rent two, rather than one tank. This results in added expense and time.

SUMMARY OF THE INVENTION

The present invention overcomes the above discussed problems and other disadvantages of the prior art by providing a bracket adapter with two arcuate cylinder receivers, held together by a curved bracket which fits into a standard SCUBA backpack. In accordance with the present invention, two angularly opposed curved gas cylinder receivers are connected to a frame. Also connected to the frame is a curved bracket with a radius comparable to the radius of a compressed air SCUBA tank.

The adapter of this invention is made of lightweight, non corrosive material. It will be appreciated that this material protects the adapter from corrosive salt water and helps to limit its weight. Straps are provided to hold the tanks in place.

A diver who uses the adapter of the present invention will realize many benefits over other current adapters. In use, in accordance with the present invention, the curved bracket is mounted on the standard backpack in the space provided for the single tank. Since the radius of the bracket and the tank are comparable, the bracket fits snugly onto the backpack. Once the adapter is mounted on the backpack, two tanks are mounted on the adapter. It will be appreciated that each tank can have a different size and shape from the other. When the tanks are strapped into place, the unit is complete. Advantages of this adapter over the prior art are its curved backpack mounting bracket, and its ability to hold tanks of separate sizes and shapes.

The present invention may be better understood and its numerous objects and advantages will become apparent to and understood by those skilled in the art from the following detailed description and drawings.

DESCRIPTION OF THE DRAWINGS

Referring now to the drawings, wherein the elements are numbered alike in the several FIGURES.

DESCRIPTION OF THE INVENTION

Figure 1:
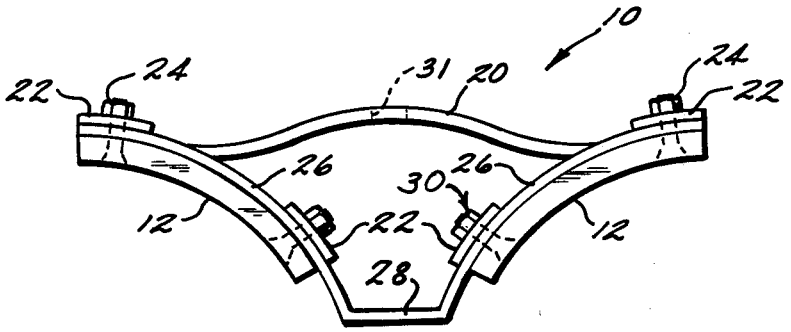
FIG. 1 is a top plan view of the dual SCUBA tank modifier of the present invention.
Figure 2:
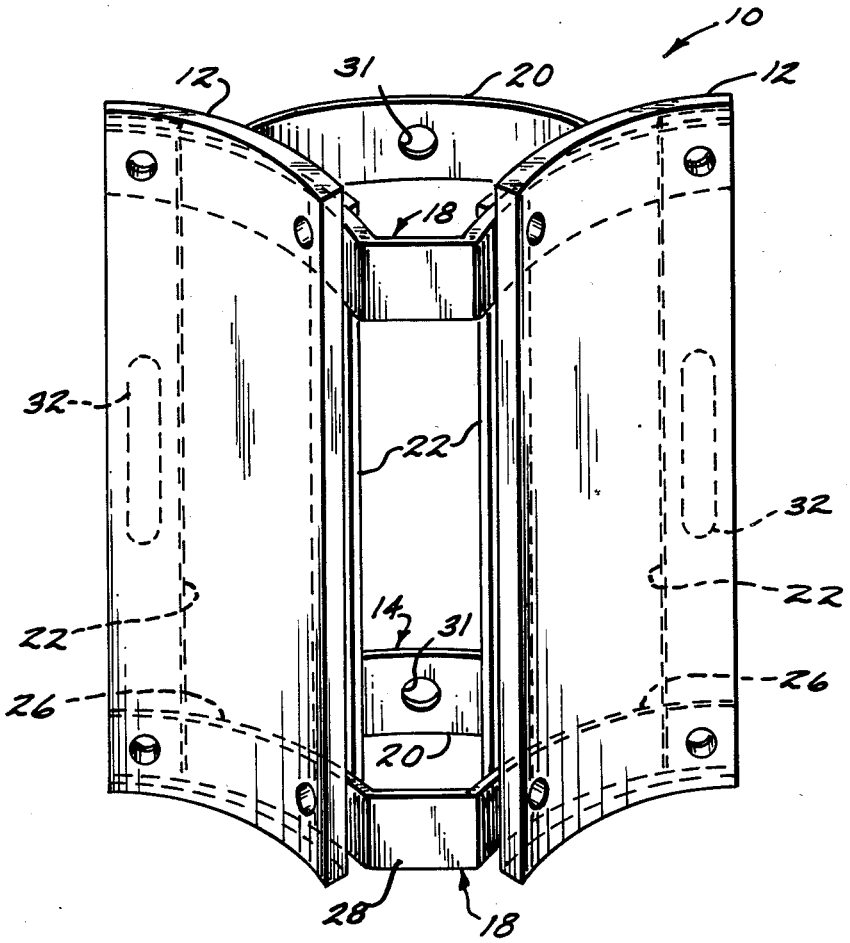
FIG. 2 is a front perspective view of the dual SCUBA tank modifier of FIG. 1.
Figure 3:
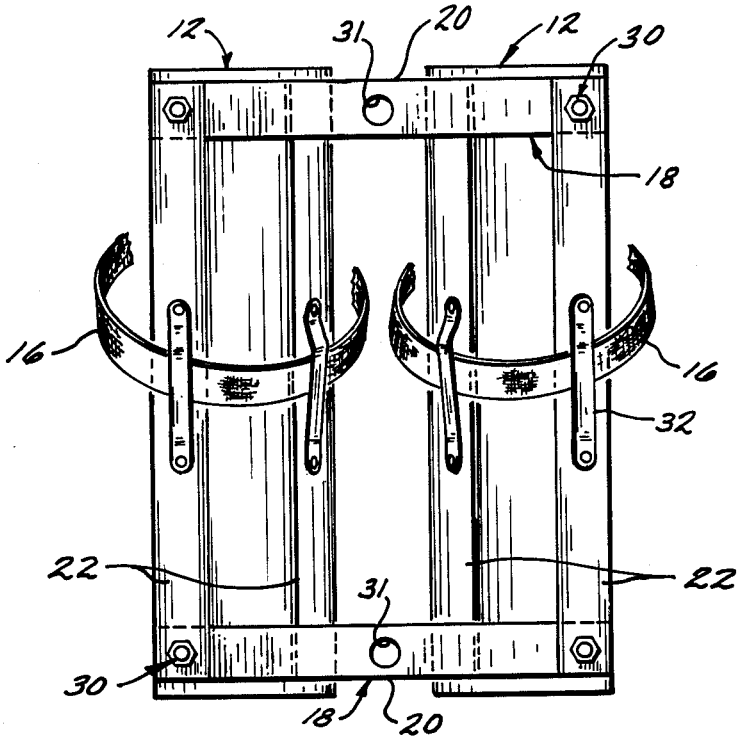
FIG. 3 is a rear perspective view of the dual SCUBA tank modifier of FIG. 1.
Figure 4:
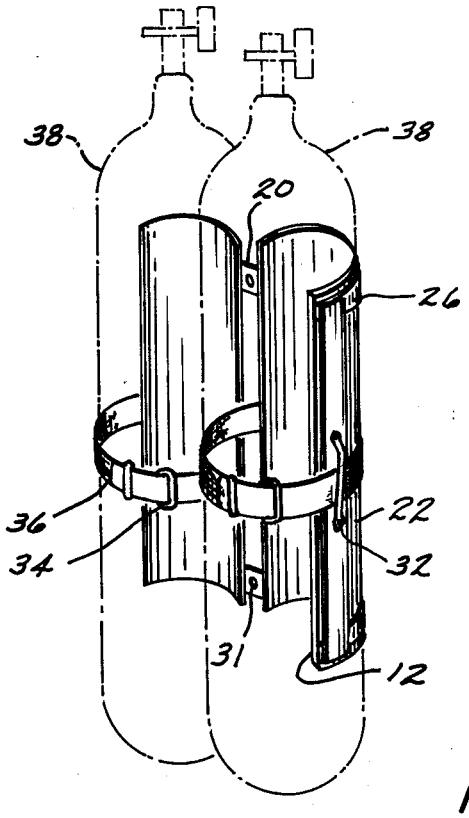
FIG. 4 is front perspective view of the dual SCUBA tank modifier of FIG. 1 showing the placement of two SCUBA tanks.

Referring to all the FIGURES jointly, a dual SCUBA tank modifier is shown generally at 10. The modifier 10 is comprised of two curved gas cylinder receivers 12, a frame 14 and straps 16. As shown in FIG. 3, curved gas cylinder receivers 12 are connected to frame 14 and straps 16 are looped around receivers 12.

Frame 14 includes a pair of spaced receiver brackets 18 and curved brackets 20. Brackets 18 are interconnected by a plurality of spatially displaced flattened elongated supports 22. Each receiver bracket 18 has two main sections including a pair of receiver sections 26 interconnected by a flat separator section 28. Receiver sections 26 are angularly opposed and rounded. In the preferred embodiment, four supports 22 interconnect brackets 18. Preferably, brackets 18 and supports 22 are held together by appropriate bolts and nuts.

Curved brackets 20 are welded or otherwise attached to receiver sections. Brackets 20 are arcuate with a radius comparable to a known cylindrical SCUBA tanks. Curved brackets 20 arch away from receiver bracket 18 and include openings 31 for receiving appropriate fasteners.

Cylinder receivers 12 are mounted to receiver sections 26 of receiver brackets 18. Receivers 12 have the same curvature as receiver sections 26 so that receivers 12 fit snugly to receiver sections 26. Fasteners 30 fasten receivers 12 to receiver section 26.

Straps 16 are connected to receivers 12 by an attachment means 32. Straps 16 are adjusted by a buckle 34 and strap surplus is held in place by a VELCRO fastening material 36. Modifier 10 is then mounted to a standard SCUBA backpack. The standard backpack has a cylindrical indentation (not shown) to fit and hold one SCUBA tank. Curved bracket 20 of modifier 10, having a radius comparable to a SCUBA tank, fits neatly into the indentation of the standard backpack. Once situated in the indentation, the curved bracket 20 is fastened by way of fastening means to the backpack. SCUBA tanks 38 are fit into receivers 12. Straps 16 are then pulled tightly around tanks 38, buckled; and the strap surplus is fastened against the VELCRO type fastening material 36. Straps 16 surround tanks 38 and tightly hold the tanks to receivers 12. The design of receiver 12 is such that receiver 12 can hold any size tank. Each receiver 12 can hold a tank of a different size. It will be appreciated that this feature increases the versatility of the present invention and decreases the SCUBA divers costs.

While preferred embodiments have been shown and described, various modifications and substitutions may be made thereto without departing from the spirit and scope of the inventions. Accordingly, it is to be understood that the present invention has been described by way of illustrations and not limitation.

What is claimed is:

1. A SCUBA tank adapter comprisng:

a pair of curved tank receiver means horizontally displaced from one another for supporting a pair of tanks;

a pair of brackets vertically spaced along the tank receiver means for spatially supporting said tank receiver means, each of said brackets comprising a pair of arcuate section, with one arcuate section of each bracket connected to one of said tank receiver means interconnected by a flattened section;

elongated tank support means for mounting said tank receiver means to said brackets;

curved adapter means which extend between said arcuate sections of said brackets and are adapted to mount onto a SCUBA backpack; and strap means for retaining SCUBA tanks to said tank receiver means.

2. The SCUBA tank adapter of claim 1 wherein:

said strap means are unitary straps which extend behind and around said tank receiver means, said strap means including adjustment means to adjust said straps in a selected position, and said strap means having fastening means to hold said straps in said selected position; and 3. The SCUBA tank adapter of claim 2 wherein:

said fastening means is a hook and loop material.

4. The SCUBA tank adapter of claim 2 wherein:

said adjustment means comprises a buckle.

5. The SCUBA tank adapter of claim 1 which further includes:

strap means mounting means which hold said strap means to said tank receiver means.

* * * * *